US005292269A

United States Patent [19]

Plost et al.

[11] Patent Number: 5,292,269

[45] Date of Patent: Mar. 8, 1994

[54] TROLLING MOTOR AUTOMATIC DISCONNECT

[76] Inventors: Gerald N. Plost, 1725 E. 19th, Tulsa, Okla. 74104; Gene B. Randall, Jr., 11635 S. 73 E. Ave., Bixby, Okla. 74008

[21] Appl. No.: 20,103

[22] Filed: Feb. 19, 1993

[51] Int. Cl.[5] ..... B63H 21/22

[52] U.S. Cl. ..... 440/1; 440/6

[58] Field of Search ..... 440/6, 7, 900, 1; 114/144 E, 153; 248/640, 643

[56] References Cited

U.S. PATENT DOCUMENTS 5,041,030 8/1991 Payne, Sr. ..... 440/6

5,069,642 12/1991 Henderson ..... 440/7

*Primary Examiner*—Jesus D. Sotelo

*Attorney, Agent, or Firm*—Catalano, Zingerman & McKay

[57] ABSTRACT

A trolling motor automatic disconnect interrupts power to a trolling motor and controller from an electrical power source when the trolling motor is not in a trolling position. A relay operated switch between the trolling motor and controller and the power source connects and disconnects the trolling motor and controller to and from the power source. Contacts mounted on and inserted into and withdrawn from the water with an immersible portion of the trolling motor sense when the immersible portion of the trolling motor is disposed in the water. An inverting amplifier responsive to the status of the contacts energizes the relay to pull the switch to the connect condition when the immersible portion of the trolling motor is disposed in the water and deenergize the relay to pull the switch to the disconnect condition when the immersible portion of the trolling motor is not in the water. A time delay circuit maintains the energization of the relay to hold the switch in the connect condition for a predetermined time after the immersible portion of the trolling motor is removed from the water so that power to the motor is not interrupted due to the propeller momentarily and unintentionally leaving the water.

Alternatively, a mercury switch or mechanical disconnect mounted on the motor may replace the contacts so that when the motor is not in a stored condition, the inverting amplifier will energize the relay, and when the motor is in a stored condition, the inverting amplifier will disengage the relay.

13 Claims, 2 Drawing Sheets

TROLLING MOTOR AUTOMATIC DISCONNECT

BACKGROUND OF THE INVENTION

This invention relates generally to boat motors and more particularly concerns trolling motors used for fishing.

Presently, trolling motors are connected to an on-board power source through a controller, generally having a pedal switch or the like operated by the pilot to activate the trolling motor.

Since the pedal switch is an externally accessible system, occasionally a trolling motor is inadvertently activated, resulting in untimely and unexpected operation of the trolling motor and the rotation of its propeller in or proximate areas of the boat accessible to passengers.

It is, therefore, an object of this invention to provide a trolling motor automatic disconnect which prevents operation of the trolling motor unless the propeller is in the water.

A further object of this invention is to provide a trolling motor automatic disconnect which will not disconnect the trolling motor from its power source while the trolling motor is in its operating position even though the immersible portion of the motor momentarily leaves the water, for example, when waves cause the propeller to lift out of the water.

SUMMARY OF THE INVENTION

In accordance with the invention, a trolling motor automatic disconnect for interrupting power to a trolling motor and controller from an electrical power source when the trolling motor is not in a trolling position.

A relay operated switch between the trolling motor and controller and the power source connects and disconnects the trolling motor and controller to and from the power source.

Contacts mounted on and inserted into and withdrawn from the water with a immersible portion of the trolling motor sense when the immersible portion of the trolling motor is disposed in the water.

An inverting amplifier responsive to the status of the contacts energizes the relay to pull the switch to the connect condition when the immersible portion of the trolling motor is disposed in the water and deenergize the relay to pull the switch to the disconnect condition when the immersible portion of the trolling motor is not in the water.

A time delay circuit maintains the energization of the relay to hold the switch in the connect condition for a predetermined time after the immersible portion of the trolling motor is removed from the water so that power to the motor is not interrupted due to the propeller momentarily and unintentionally leaving the water.

BRIEF DESCRIPTION OF THE DRAWINGS

Other objects and advantages of the invention will become apparent upon reading the following detailed description and upon reference to the drawings in which.

While the invention will be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION

Figure 1:
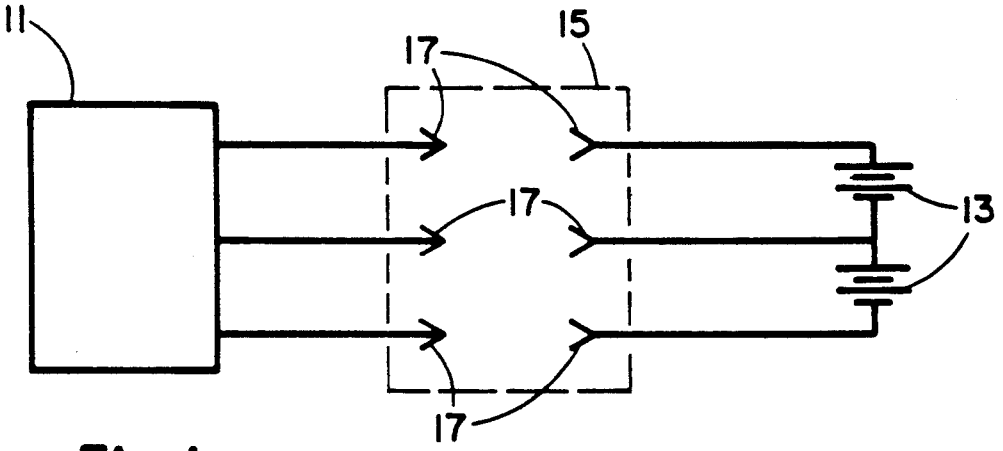
FIG. 1 is a block diagram illustrating the typical power connection of a trolling motor and controller to its power source.

Turning first to FIG. 1, a typical trolling motor and controller 11 are to be driven by an electrical power source such as a pair of 12 volt batteries 13 in a typical three-wire connection 15. Generally, the controller includes a pedal switch (not shown) used by the pilot to control the operation of the trolling motor.

Figure 2:
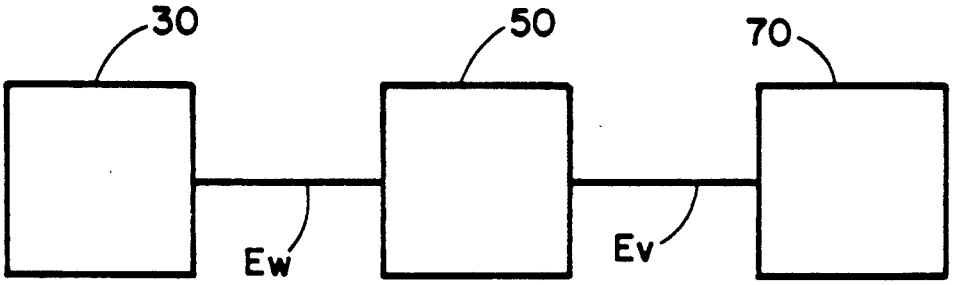
FIG. 2 is a block diagram illustrating the component parts of a preferred embodiment of the trolling motor automatic disconnect.

A preferred embodiment of a trolling motor automatic disconnect is illustrated in FIG. 2. The disconnect consists of a water sensor circuit 30, a wave detection circuit 50 and a switching interface circuit 70. The water sensor circuit 30 senses the immersion of the immersible portion of the trolling motor in water and provides an output signal $E_W$ to the wave detection circuit 50. The wave detection circuit 50 maintains an output signal $E_V$ to the switching circuit 70 when the trolling motor propeller inadvertently leaves the water. When the signal $E_V$ indicates the presence of the immersible portion of the trolling motor in the water, the switching circuit 70 completes the interface between the power source 13 and the trolling motor and controller 11 so that the trolling motor can be activated by operation of the pedal switch by the pilot.

Figure 3:
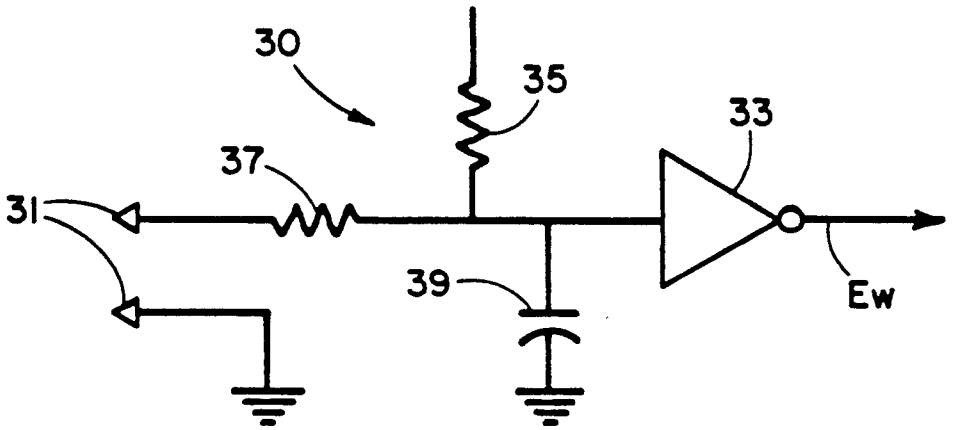
FIG. 3 is a preferred embodiment of the water sensor circuit of the trolling motor automatic disconnect of FIG. 2.

Looking at FIG. 3, a preferred embodiment of the water sensor circuit 30 is illustrated in more detail. A pair of contacts 31 mounted on the immersible portion of the trolling motor are electrically connected or disconnected by immersion into or withdrawal from the water, respectively. An inverting amplifier 33 is connected via a first biasing resistor 35 to a biasing voltage, typically the boat batteries 13, which pulls the input of the amplifier 33 high and the output of the amplifier 33 low. A second resistor 37 connected between the input to the inverting amplifier 33 and the contacts 31 on the immersible portion of the trolling motor provides a total resistance from the input of the inverting amplifier 33 through the water which is significantly less than the resistance of the biasing resistor 35. Thus, when the contacts 31 are immersed in water, the input to the inverting amplifier 33 is pulled low. The result is that the output of the inverting amplifier 33 is high when the contacts 31 are immersed in water. A capacitor 39 connected between the input of the inverting amplifier 33 and ground prevents circuit noise from triggering the system.

Figure 4:
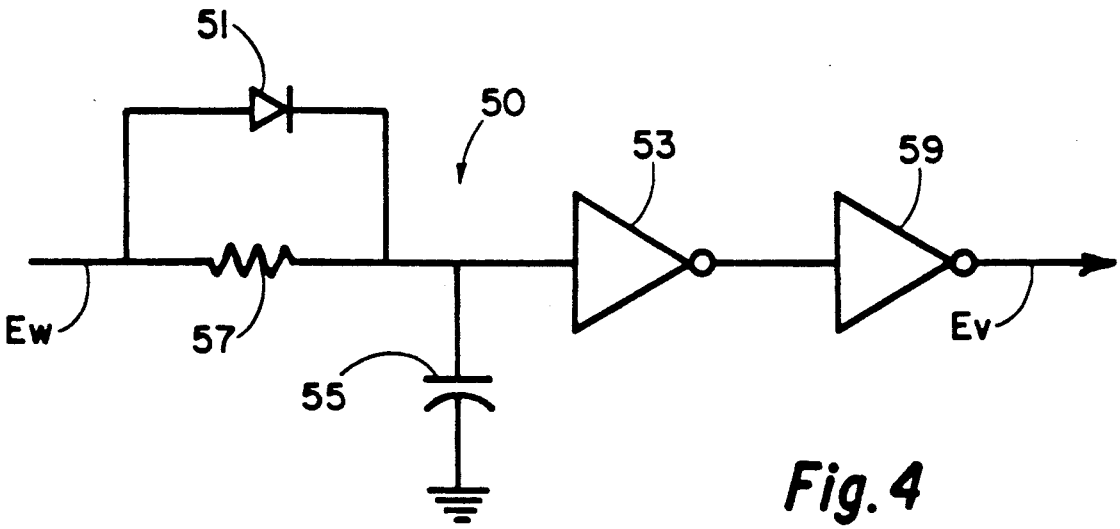
FIG. 4 is a schematic diagram of a preferred embodiment of the wave detection circuit of the trolling motor automatic disconnect of FIG. 2.
Figure 5:
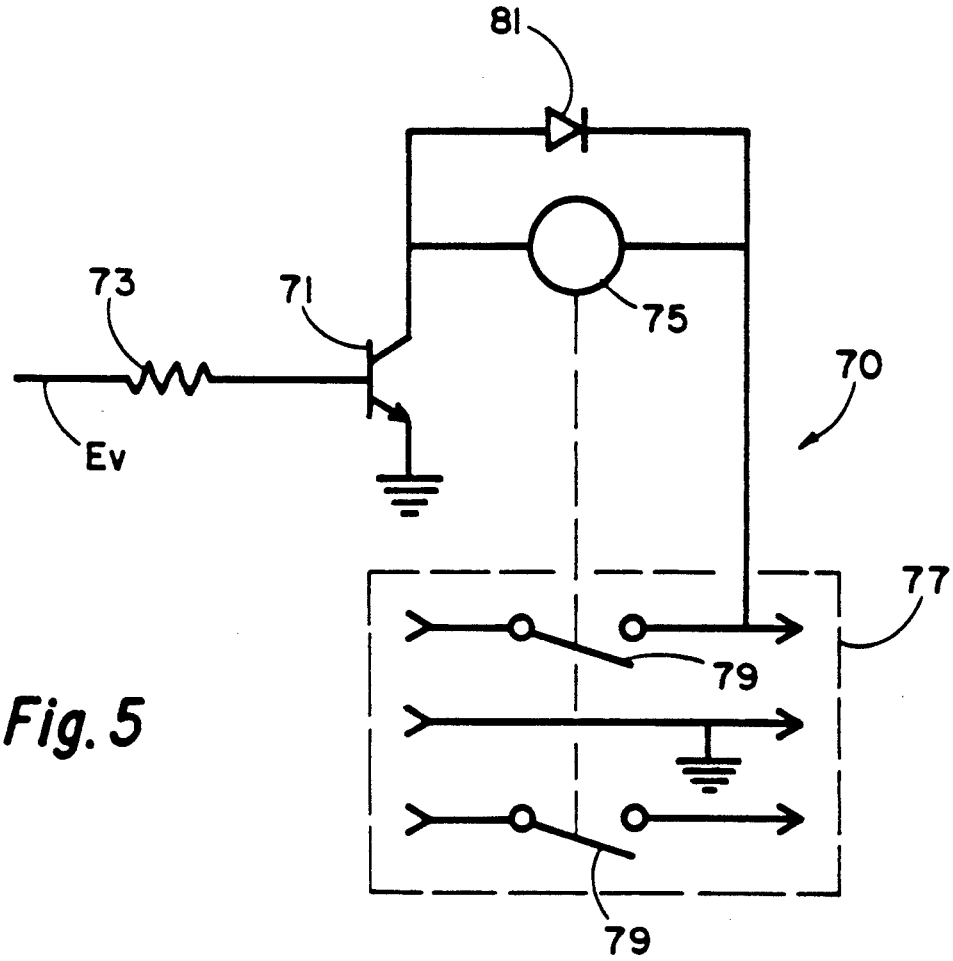
FIG. 5 is a preferred embodiment of the switching interface circuit of the trolling motor automatic disconnect of FIG. 2.

A preferred embodiment of the wave detection circuit 50 is illustrated in FIG. 4. When the contacts 31 on the immersible portion of the trolling motor are immersed in water, the high output of the water sensor circuit inverting amplifier 33 is passed via a diode 51 to a first inverting amplifier 53 in the wave detection circuit 50. As long as the contacts 31 are immersed in water, the output of the water sensor inverting amplifier 33 is high and therefore the input to the first inverting amplifier 53 of the wave detection circuit 50 is high. A capacitor 55 connected to ground between the diode 51 and the first inverting amplifier 53 of the wave detection circuit 50 charges as the diode 51 passes the high signal. If completion of the circuit at the contacts 31 is inadvertently interrupted, for example, by waves causing the propeller to leave the water, the capacitor 55 will discharge through a resistor 57 in parallel with the diode 51 and maintain the high input to the first inverting amplifier of the wave detection circuit for a predetermined time, perhaps five seconds, so that operation of the trolling motor will not be discontinued. If the output of the sensor circuit inverting amplifier 31 remains low for this period of time, then the input to the first inverting amplifier 53 of the wave detection circuit 50 will also go low. The output of the first inverting amplifier 53 of the wave detection circuit 50 is fed to an input of a second inverting amplifier 57 so that the output of the wave detection circuit 50 will be high when the contacts 31 ar immersed in water.

A preferred embodiment of the switching interface circuit 70 consists of a grounded emitter transistor 71 having its base connected to the output $E_V$ of the wave detection circuit 50 through a resistor 73 and its collector connected through a twelve volt relay 75 to an interface 77 having pole contacts 79. Thus, when the output $E_V$ of the wave detection circuit 50 is high, the relay 75 is energized through the transistor 71 and the pole contacts 79 are closed in the interface 77. A diode 81 connected across the relay 75 suppresses any electromagnetic surge that might occur from the operation of the circuit.

In operation, the interface 77 is connected between the contacts 17 of the typical three wire connection 15 illustrated in FIG. 1 and the water contacts 31 are mounted on the immersible portion of the trolling motor. Thus, the trolling motor and controller 11 are connected through the pole contacts 79 to the power source 13.

The state of the pole contacts 79 is responsive to the state of the water contacts 31. When the immersible portion of the trolling motor is immersed in water, the water contacts 31 are also immersed. This initiates the operation of the inverting amplifiers 33, 53 and 59 to engage the relay 75 and close the pole contacts 79, allowing operation of the trolling motor in response to its own controller circuitry. If the trolling motor propeller leaves the water for less than the delay time established by the capacitor 55 and resistor 57, the relay 75 remains energized and the trolling motor continues to operate. If the propeller leaves the water for more than the established delay time, the relay 75 is de-energized and the trolling motor is automatically disconnected from the power source 13.

The preferred embodiment of the trolling motor automatic disconnect has been illustrated in relation to a three wire two battery configuration. However, the system can be readily adapted for use with a two wire, single battery system or two wire, multiple battery system by the use of a appropriate connector.

In addition, the water sensing contacts 31 could be replaced by a mercury switch detecting the tilting of the trolling motor out of the stored position or by a mechanical disconnect triggered by the tilting of the trolley motor out of the stored position.

In one embodiment of the trolling motor automatic disconnect, the component parts are as follows:

| NO. | COMPONENT | TYPE |
|---|---|---|
| 31 | water contacts | brass |
| 33 | inverting amplifier | 74C14 |
| 35 | resistor | 4.7 MEG |
| 37 | resistor | 10.0K |
| 39 | capacitor | 0.1 Mfd |
| 51 | diode | 1N4148 |
| 53 | inverting amplifier | 74C14 |
| 55 | capacitor | 100 Mfd 16 volt |
| 57 | resistor | 120K |
| 59 | inverting amplifier | 74C14 |
| 71 | transistor | MPS-A13 |
| 73 | resistor | 10K |
| 75 | relay | T92S11D22-12 |
| 77 | connector | (to match system) |
| 81 | diode | 1N4004 |

Thus, it is apparent that there has been provided, in accordance with the invention, a trolling motor automatic disconnect that fully satisfies the objects, aims and advantages set forth above. While the invention has been described in conjunction with specific embodiments thereof, it is evident that many alternatives, modifications and variations will be apparent to those skilled in the art and in light of the foregoing description. Accordingly, it is intended to embrace all such alternatives, modifications and variations as fall within the spirit of the appended claims.

What is claimed is:

1. For interrupting power to a trolling motor and controller from an electrical power source when the trolling motor is not in a trolling position, an automatic disconnect comprising:

means between the trolling motor and controller and the power source for electrically connecting and disconnecting the trolling motor and controller to and from the power source;

means for switching said connecting and disconnecting means between a connect condition and a disconnect condition;

means mounted on and movable with the trolling motor for sensing when the immersible portion of the trolling motor is not in a stored position; and means responsive to said sensing means for electrically energizing said switching means to said connect condition when the immersible portion of the trolling motor is not in said stored position and for electrically deenergizing said switching means to said disconnect condition when the immersible portion of the trolling motor is in said stored position whereby operation of a propeller driven by the trolling motor is controlled.

2. An automatic disconnect according to claim 1, said sensing means comprising switch contacts disposed on an immersible portion of the trolling motor, the electrical path between said contacts being completed by immersion thereof in water.

3. An automatic disconnect according to claim 1, said sensing means comprising a mercury switch.

4. An automatic disconnect according to claim 1, said sensing means comprising a mechanical disconnect.

5. For interrupting power to a trolling motor and controller from an electrical power source when the trolling motor is not in a trolling position, an automatic disconnect comprising:

means between the trolling motor and controller and the power source for electrically connecting and disconnecting the trolling motor and controller to and from the power source;

means for switching said connecting and disconnecting means between a connect condition and a disconnect condition;

means mounted on and inserted into and withdrawn from the water with a propeller portion of the trolling motor for sensing when the propeller portion of the trolling motor is disposed in the water; and means responsive to said sensing means for electrically energizing said switching means to said connect condition when the propeller portion of the trolling motor is disposed in the water and for electrically deenergizing said switching means to said disconnect condition when the propeller portion of the trolling motor is not in the water.

6. An automatic disconnect according to claim 5 further comprising means for maintaining said switching means in said connect condition for a predetermined time after the propeller portion of the trolling motor is removed from the water.

7. For interrupting power to a trolling motor and controller from an electrical power source when the trolling motor is not in a trolling position, an automatic disconnect comprising:

a relay switch having pole contacts connected between the trolling motor and controller and the power source;

a pair of spaced apart electrical contacts mounted on and inserted into and withdrawn from the water with a immersible portion of the trolling motor, the electrical path between said contacts being electrically completed by insertion thereof in the water;

means for electrically energizing said relay switch to close said pole contacts when the immersible portion of the trolling motor is disposed in the water and for electrically deenergizing said relay switch to open said pole contacts when the immersible portion of the trolling motor is not in the water.

8. An automatic disconnect according to claim 7 further comprising means for maintaining energization of said relay switch to close said pole contacts for a predetermined time after the immersible portion of the trolling motor is removed from the water.

9. For interrupting power to a trolling motor and controller from an electrical power source when the trolling motor is not in a trolling position, an automatic disconnect comprising:

a relay switch having pole contacts connected between the trolling motor and controller and the power source;

a pair of spaced apart electrical contacts mounted on and inserted into and withdrawn from the water with a immersible portion of the trolling motor, said contacts being electrically connected by insertion thereof in the water;

an inverting amplifier having an input connected to one of said pair of contacts and to a bias voltage source and an output which is high when said pair of contacts are inserted into the water and low when said pair of contacts is not inserted into the water; and means electrically connecting said amplifier output to said relay switch for closing said pole contacts when the immersible portion of the trolling motor is disposed in the water and for electrically deenergizing said relay switch to open said pole contacts when the immersible portion of the trolling motor is not inserted in the water.

10. An automatic disconnect according to claim 9 further comprising a time delay circuit connected between said amplifier output and said connecting means for maintaining energization of said relay switch to close said pole contacts for a predetermined time after the immersible portion of the trolling motor is removed from the water.

11. An automatic disconnect according to claim 9, said connecting means having a transistor with its base connected to said amplifier output and its collector and emitter connected in series with said relay switch.

12. An automatic disconnect according to claim 11, said connecting means further having a pair of inverting amplifiers connected in series between said transistor base and said time delay circuit.

13. An automatic disconnect according to claim 12 further comprising a diode connected in parallel with said relay switch for suppressing electromagnetic surges.

* * * * *